US005322232A

United States Patent [19]

Freeman et al.

[11] Patent Number: 5,322,232

[45] Date of Patent: Jun. 21, 1994

[54] PORTABLE PAPER TRIM REMOVAL SYSTEM WITH TRIM REWINDER AND DUST VACUUM

[75] Inventors: Ross A. Freeman; Kenneth E. McDonald, both of Somersworth, N.H.

[73] Assignee: Moore Business Forms, Inc., Grand Island, N.Y.

[21] Appl. No.: 916,730

[22] Filed: Jul. 22, 1992

[51] Int. Cl.[5] ..... B65H 41/00

[52] U.S. Cl. ..... 242/67.10 R; 270/52.5

[58] Field of Search ..... 242/67.1 R, 67.5, 56.4; 220/52.5

[56] References Cited

U.S. PATENT DOCUMENTS

| | | | |
|---|---|---|---|
| 2,734,692 | 2/1956 | Robinson | 242/74 |
| 3,144,216 | 8/1964 | Billingsley | 242/56.4 |
| 3,222,006 | 12/1965 | Bahnsen | 242/67.1 |
| 3,406,924 | 10/1968 | Bruns et al. | 242/56.4 |
| 3,857,557 | 12/1974 | Gill et al. | 242/56.2 X |
| 4,061,287 | 12/1977 | Shakespeare | 242/67.1 |
| 4,467,974 | 8/1984 | Crim | 242/55.53 |
| 4,467,975 | 8/1984 | Friedman | 242/56.4 |
| 4,500,046 | 2/1985 | Woenker | 242/67.1 |
| 4,572,496 | 2/1986 | Casper et al. | 270/52.5 |
| 4,892,265 | 1/1990 | Cox | 242/67.1 |
| 5,062,582 | 11/1991 | Harmon et al. | 242/56.4 |
| 5,194,062 | 3/1993 | Membrino | 242/67.5 X |

FOREIGN PATENT DOCUMENTS

| | | | |
|---|---|---|---|
| 1073781 | 6/1967 | United Kingdom | 242/67.1 R |

*Primary Examiner*—Daniel P. Stodola
*Assistant Examiner*—John P. Darling
*Attorney, Agent, or Firm*—Nixon & Vanderhye

[57] ABSTRACT

A system for collecting paper trim and dust automates and simplifies the removal and disposal of trim. The system includes a funnel receiving the paper trim from an automatic trimmer, a drum and rewinder for winding the paper trim into a bale, and a dust trap for sucking dust from the drum and funnel into a dust bin. As the trim is baled, the rewinder drags the paper bale against the side of the drum. This drag compacts the bale and increases the load on the rewinder. As the drag load on the rewinder increases, the rewinder is moved radially towards the center of the drum to increase the distance between the rewinder and the drum wall. A current sensing circuit triggers the radial movement of the rewinder when the current load on the rewinder motor exceeds a threshold limit. This radial movement reduces the drag on the rewinder. When the rewinder reaches the center of the drum and the trim bale fills the drum, the rewinder is stopped and the trim bale removed.

13 Claims, 7 Drawing Sheets

PORTABLE PAPER TRIM REMOVAL SYSTEM WITH TRIM REWINDER AND DUST VACUUM

FIELD OF THE INVENTION

This invention relates web handling apparatuses, and more particularly, to paper trim rewinders and dust collectors.

BACKGROUND AND SUMMARY OF THE INVENTION

Paper trim and dust must be collected and discarded in many paper handling systems. For example, high speed computer printers have tractor feeders that engage the tractor drive strips at the outer edges of a continuous web of paper. In post-processing equipment, the tractor drive strips are often trimmed away from the paper web. These paper strips are then thrown out or recycled. In addition, paper dust is generated as the strips of paper are trimmed. This dust should also be collected and discarded so that the operators do not breath the dust, and the dust does not coat the printer and post-processing area.

Previously, the collection of paper trim strip's was usually done manually by the operator who picked the trim off the floor. An example of an automatic trim rewinder is shown in U.S. Pat. No. 4,572,496, entitled "Trim Rewinder With Automatic Stop" and issued to Mark Casper and Robert Thomson on Feb. 25, 1986. However, the rewinder disclosed in the '496 Patent has no means to collect dust, requires a pressure plate to compact the baled trim, and the rewinder is rotatably fixed with respect to paper drum.

In the present invention, after the paper trim strips are mechanically trimmed from the paper web, the strips and associated dust fall into a funnel beneath the trimmer. A vacuum hose connected to the bottom of the funnel draws the trim strips and dust from the funnel and passes them into a cylindrical drum.

In the drum is a rewinder having a pair of rotating tines. These tines catch the paper strips and spin the strips into a paper bale. Initially, the rewinder tines are near the bottom of the drum so that the rotating paper bale is compacted as it is dragged against the drum bottom by the rotating tines. As the paper bale increases in size, the rewinder moves upward toward the center of the drum to allow more of the paper trim strips to be wound onto the bale. When the rewinder reaches the center of the drum, the paper bale fills the drum. At this point, the rewinder stops, the bale of paper is removed from the drum, and the bale is discarded or recycled.

The dust from the trimming operation is drawn by suction into the funnel through the hose and into the paper drum. The dust falls to the bottom of the drum into a dust trap. The dust falls to the bottom of the dust trap. Clean air is sucked out of the dust trap by a vacuum pump. The paper dust is discarded or recycled after being collected in the separator.

An electronic controller monitors the current load on the rewinder motor. The mechanical load on the rewinder increases as the paper bale expands and fills the space between the rewinder tines and the bottom of the drum. This increasing mechanical load increases the current load on the rewinder motor When the current load exceeds a threshold limit, the electronic controller triggers an elevator motor to move the rewinder towards the center of the drum. In this way, the controller automatically moves the rewinder to the center of the drum as the paper bale fills the drum.

One advantage of this invention is that it automatically removes and collects paper trim and dust. Another advantage of this invention is that its rewinder has fewer mechanical moving parts than prior rewinders. Furthermore, this invention advantageously adjusts the rewinder by monitoring current load. In addition, the invention is portable and can be easily adapted to a wide variety of printers and locations.

BRIEF DESCRIPTION OF THE DRAWINGS

The preferred embodiment of the invention is described in relation to the accompanying drawings These drawings are as follows.

DETAILED DESCRIPTION OF THE DRAWINGS

Figure 1:
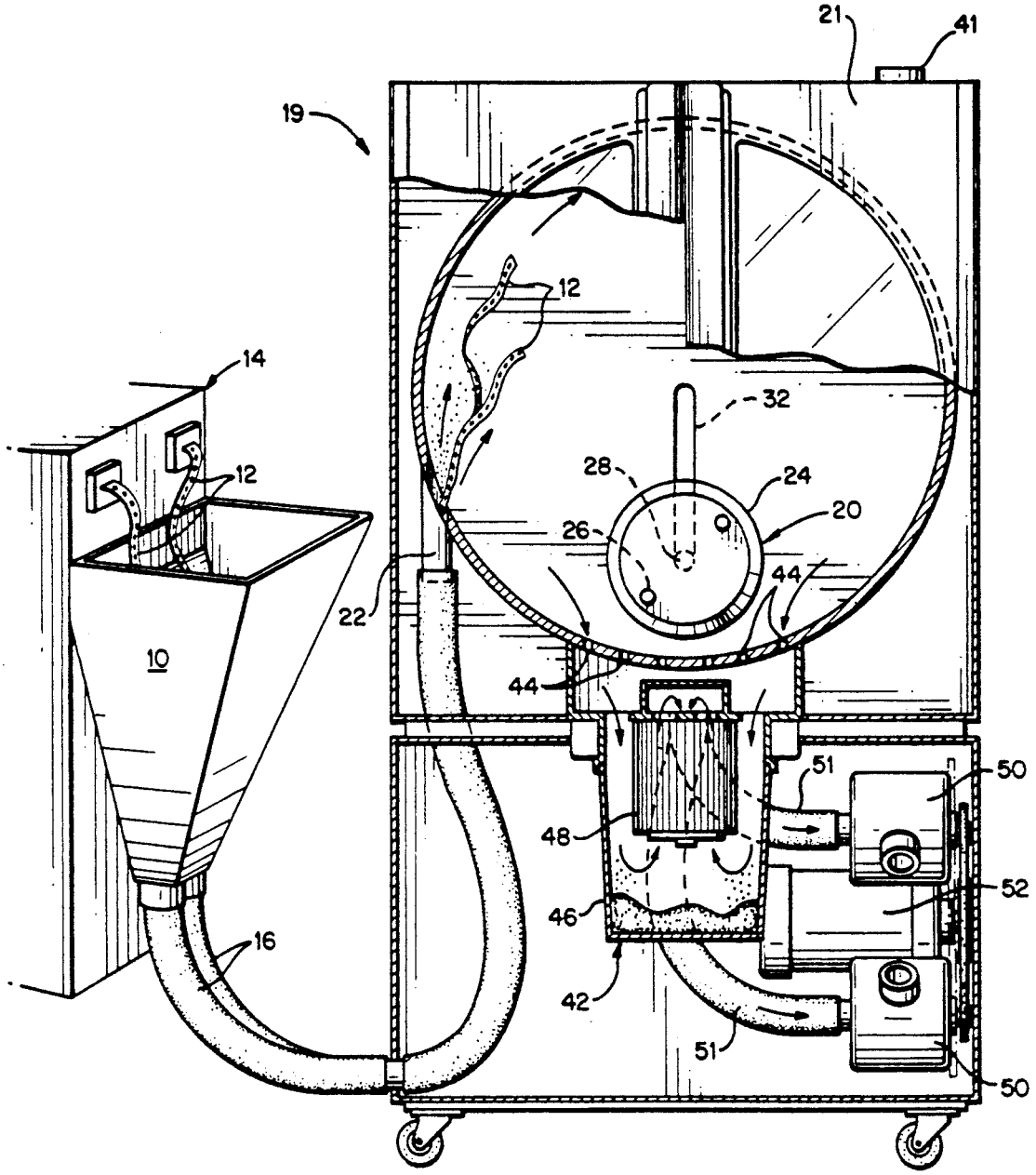
FIG. 1 is a front cross-sectional view of the preferred embodiment of the invention.
Figure 2:
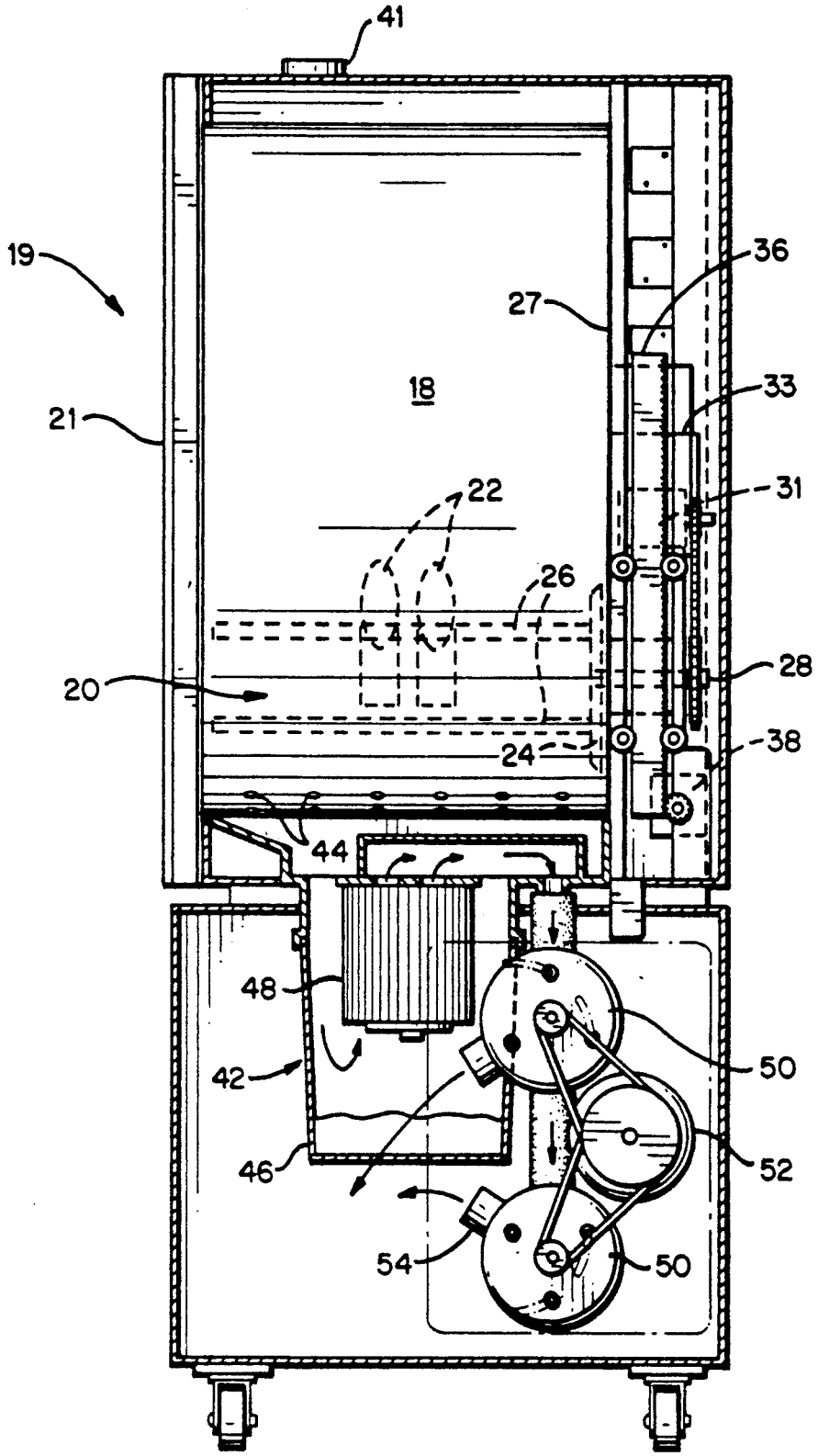
FIG. 2 is a side cross-sectional view of the drum rewinder shown in FIG. 1.
Figure 3:
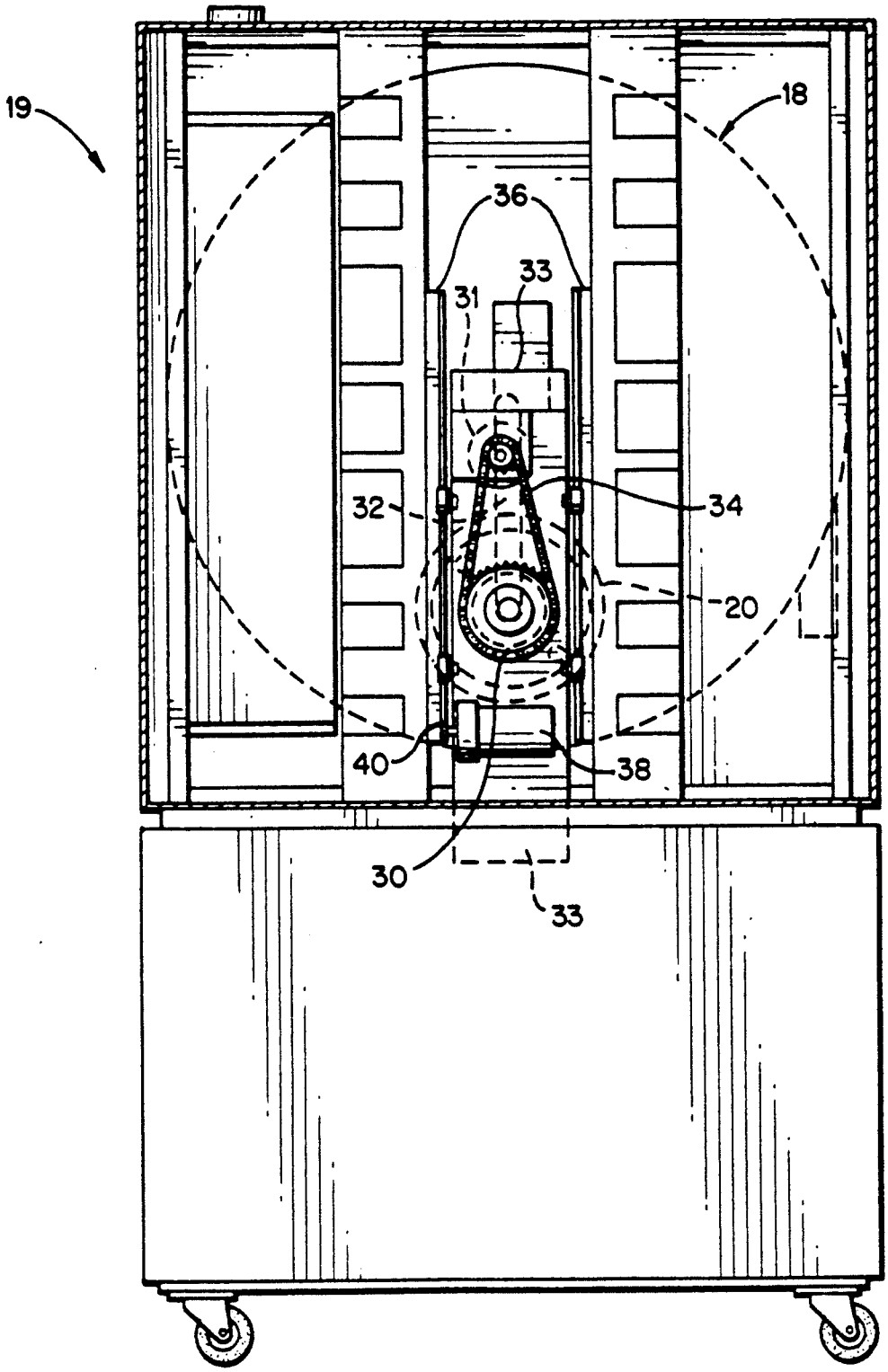
FIG. 3 is a rear cross-sectional view of the drum rewinder shown in FIG. 1.

As shown in FIGS. 1 to 3, the preferred embodiment of the present invention includes a rectangular funnel 10 receiving a pair of continuous paper tractor drive strips 12 that have been trimmed from a web of paper by an automatic trimmer detacher 14. A vacuum hose 16 connected to the bottom of the funnel draws the paper strips and dust from the funnel, and passes them into a cylindrical drum 18 of the portable trim rewinder and dust vacuum 19.

For illustrative purposes, the interior of the drum is shown in FIG. 1 so that the operation of the rewinder 20 can been seen. In operation, the drum would be closed and access to the drum would be through a door 21 (FIG. 2) to the drum. When this door is sealed shut, the drum is air tight to preserve the suction of air through the system.

The hoses 16 attach to a pair of hollow ports 22 in the side of the drum. These ports are vertically mounted through the side of the cylindrical drum. As the paper trim strips enter the drum through the port, the velocity of the strips causes the strips to fly upward within the drum over the rewinder 20 and fall to the bottom of the drum. However, in other embodiments the paper strips may simply fall to the bottom of the drum without flying over the rewinder.

The rewinder 20 includes a rigid disk 24 structurally supporting a pair of fork tines 26 perpendicular to the disk. The parallel tines are rigid. When the tines are rotated, they catch the paper trim strips from the bottom of the drum. The rotating tines wind the strips into a paper bale. The disk 24 is located adjacent an end 27 of the drum and is mounted on a shaft 28 extending from a sprocket 30 that is chain driven by rewinder motor 31. This shaft extends through a vertical slot 32 in the end of the drum. The slot extends several inches above the bottom of the drum to the center of the drum. The slot is sealed by a rectangular sled 33 on the outside of the drum covering the slot. The sled preserves the air tight seal of the drum and prevents paper dust from escaping from the drum through the slot. The sled also carries the rewinder sprocket 30, chain drive 34 and rewinder motor 31.

The sled 33 rides along a pair of vertical rails 36 affixed to the outside of the drum. These rails are adjacent and parallel to the vertical slot 32. During operation, the sled with the rewinder and rewinder motor 30 move from the bottom of the drum upward along rail 36 toward the center of the drum. The sled is propelled upwards by an elevator motor 38 mounted on the sled. The gear teeth 40 from the elevator motor engage the gear teeth on the rails 36 to move the sled. As the sled with the rewinder moves upwards, the tines of the rewinder move from the drum bottom toward the center of the drum. When the rewinder has moved to the center of the drum, the trim light 41 illuminates. In addition, a display (not shown) may be attached to the system to show ICONS, such as "door open/not ready," "trim full," and "suction air flow < too much, too little, off >." These ICONS show the system status to the operator.

A dust trap 42 is located underneath the drum 18 to collect the paper dust from the drum. Dust within the drum falls to the bottom of the drum, is sucked through holes 44 in the bottom of the drum, and drops into the dust trap. This flow of dust into the trap is facilitated by the vacuum suction that pulls air and dust into the trap and exhausts air.

As the dust drops into the cylindrical bin 46, the dust is collected and later discarded or recycled. The air entering the bin is drawn upward through a cylindrical dust filter 48 in the top of the bin. After the air passes through the filter, it is free of dust and enters a pair of vacuum pump fans 50. These vacuum fans are belt driven by a motor 52 mounted between the fans. These cylindrical fans create the vacuum suction for the entire trim rewinder system 19 including the funnel 10, hoses 16, drum 18, dust hoses 51 and dust trap 42. Clean air drawn out of the system by the vacuum fans is discharged through a port 54 to the atmosphere.

Figure 4:
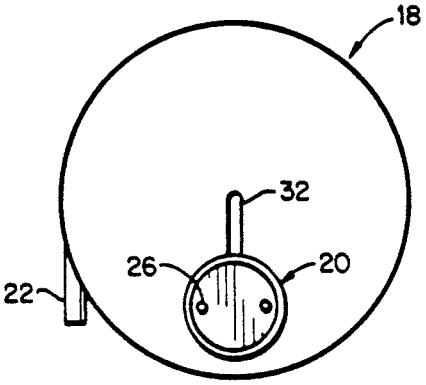
FIGS. 4 to 6 illustrate the operation of the rewinder and drum shown in FIGS. 1 and 2.

The operation of the rewinder and drum are shown in FIGS. 4 to 7. As shown in FIG. 4, before paper trim strips enter the drum 18, the rewinder 20 is positioned at the bottom of the slot 32 and near the bottom of the drum. As the paper trim strips 12 enter the drum through ports 22 and fall to the bottom of the drum, the tines 26 of the rotating rewinder catch the strips and wind the strips into a bale 56. As the paper bale spins with the rewinder, it continuously gathers the strips entering the drum. As more trim strips enter the drum, the bale become larger and fills the gap between the rewinder tines and the bottom of the drum.

Figure 5:
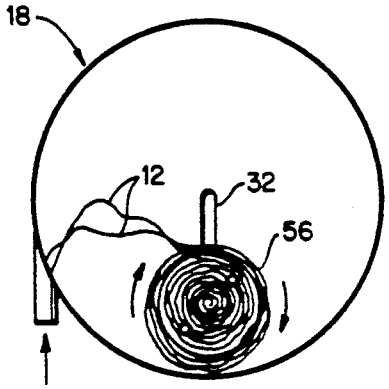

As shown in FIG. 5, the bale is wound tightly and compacted because the bale is pulled between the bottom of the drum and the tines of the rewinder. As the amount of paper trim in the bale increases, the bale increases in size and drags along the bottom of the drum. The drag increases the mechanical load on the rewinder motor 31. As this drag increases, the current load on the rewinder motor also increases to counteract the increased mechanical load. When the current load on the rewinder motor reaches a preselected threshold current limit, the trim circuit triggers the elevator motor 38 to increment the rewinder and sled slightly upward in the drum.

Figure 6:
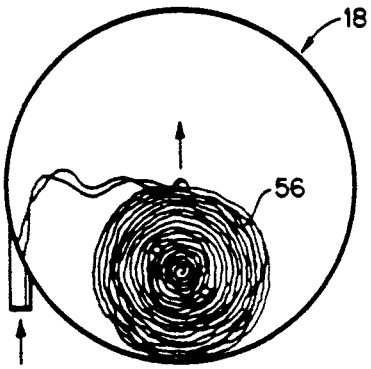
Figure 7:
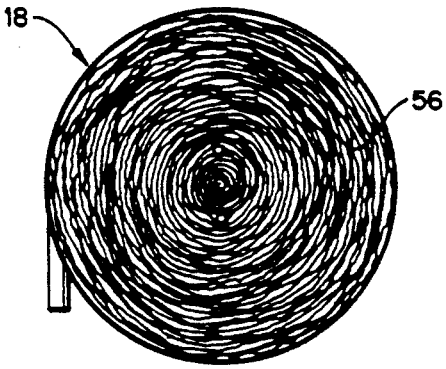

As shown in FIG. 6, the upward movement of the rewinder provides additional space between the tines and the bottom of the drum for the growing paper bale. The current load on the rotating motor decreases because the drag from paper bale is reduced. However, as the paper bale grows further and again fills the gap between the tines and the bottom of the drum, the mechanical and current drag on the rewinder and its motor again increases to the threshold current limit. When this limit is reached, the trim circuit again triggers the elevator circuit to increment the rewinder upward in the drum. This cycle is repeated until the rewinder is at the drum center and the paper bale fills the drum as is shown in FIG. 7.

When the rewinder 20 reaches the center of the drum, the system 19 including rewinder and vacuum pump is stopped. The paper bale is removed by opening the door 21 to the drum and pulling the paper bale out. When the drum door is closed, the elevator motor 37 lowers the rewinder and rotating motor to the bottom of the slot and drum.

Figure 8:
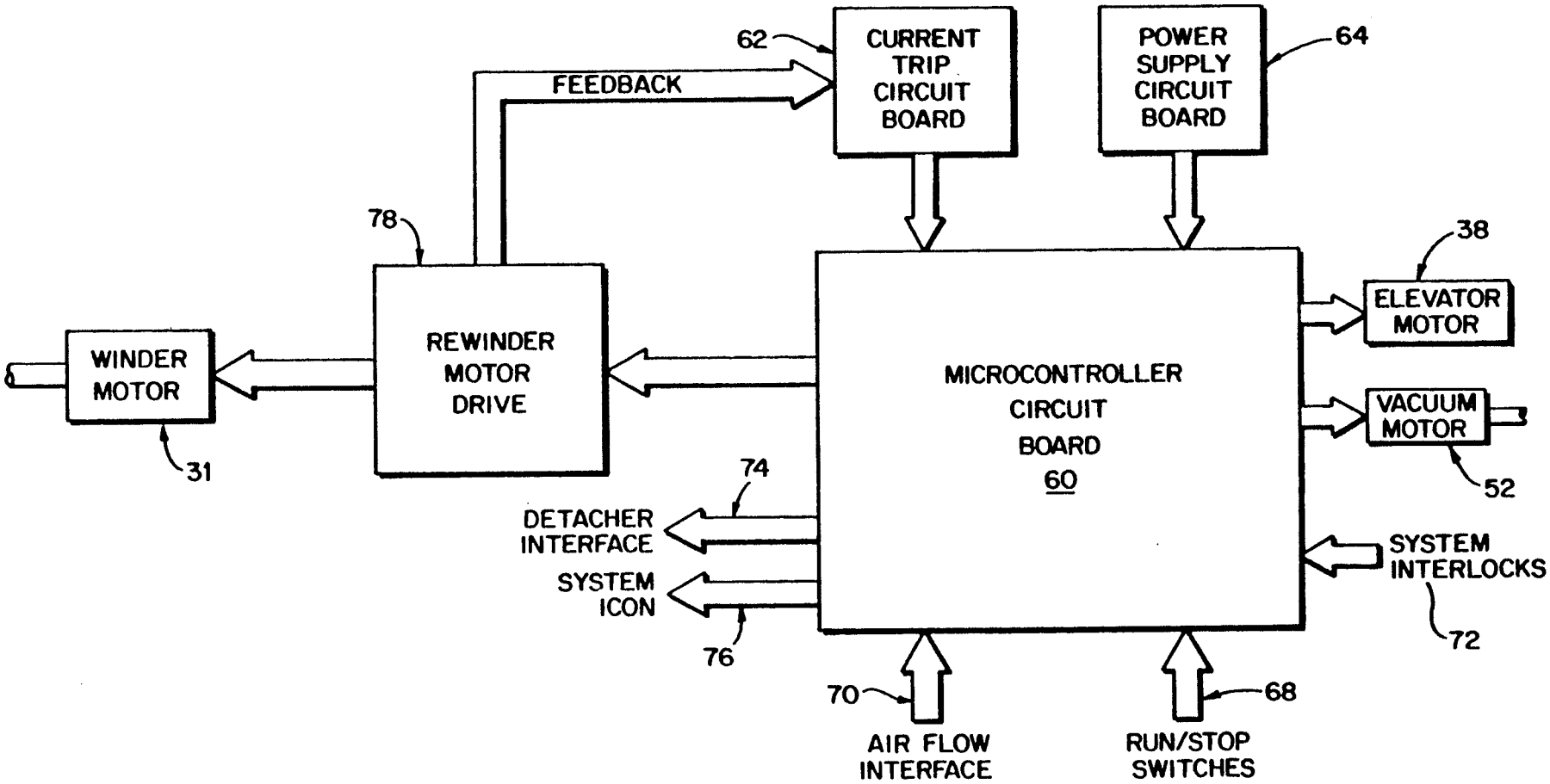
FIG. 8 is a block diagram of the electronic and electrical circuits used in the preferred embodiment of the invention.

FIG. 8 is a block diagram of the electronic circuitry controlling the rewinder/vacuum system 19 and, in particular, the system motors. A microcontroller circuit 60 provides overall control and logic functions for the system. The microcontroller circuit is a conventional circuit including a programmable microcontroller; a memory device, e.g. EPROM chip, storing the operating program executed by the microcontroller; a memory device, e.g. RAM chip, providing temporary storage for the microcontroller; interfaces to other circuits and peripheral inputs/outputs to the microcontroller circuit, and a bus connecting these devices to the microcontroller.

The microcontroller circuit receives various inputs. The current trip circuit board 62 provides the microcontroller with a signal that the threshold current has been reached in the rewinder motor. Motor current is sensed by the rewinder motor drive 78, e.g., KBIC-120 motor drive, which has a voltage output proportional to motor current The voltage output is provided to the current trip 62 circuit board. The threshold current signal causes the microcontroller to signal and activate the elevator motor 38. The elevator motor incrementally moves the rewinder 20 upward in the drum. The current trip circuit board is discussed more fully with respect to FIG. 9.

The power supply circuit 64 supplies power to the microcontroller circuit board. The run/stop switches 68 are manually operated switches used by the human operator to turn the system on and off. In addition, an interlock switch is incorporated in the drum door 21 and, optionally, the detacher may be directly interfaced for automatic control of the system. The microcontroller regularly checks these switches and appropriately starts, or stops, the system depending on the status of these switches.

The air flow interface 70 provides a vacuum sensor signal to the microcontroller indicating the level of air flow in the system. In this way, the microcontroller monitors the air flow suction while the system is operating. The system interlocks 72 include a network of snap action relays to assure safe operation should the microcontroller board fail. The detacher interface 74 provides signals to the microcontroller indicative of whether the detacher is attached to the system and is operating. Similarly, the microcontroller sends signals through the detacher interface to stop or "ready" the detacher. The system icon 76 operates a display for system status ICONS. For example, the microcontroller can activate the display to indicate whether the air flow is adequate, too much or too little.

The microcontroller 60 sends control signals, e.g. start and stop signals, to the rewinder motor drive 78, elevator motor 38 and vacuum motor 52. To prevent unnecessary wear on these motors, the microcontroller incorporates brief time-out delays before starting or stoping the motors in response to a run/stop signal or a signal from the current trip circuit board. When the motors are started, a current surge is generated that can cause the voltage signal from the current trip circuit to be beyond the threshold current limit for the rewinder motor. The programmed time-out delays prevent the motors from being quickly turned off and on due to current surges. Similarly, there may be other initialization conditions that might cause false start or stop signals, and these conditions are overcome by having the microcontroller execute brief delays.

Figure 9:
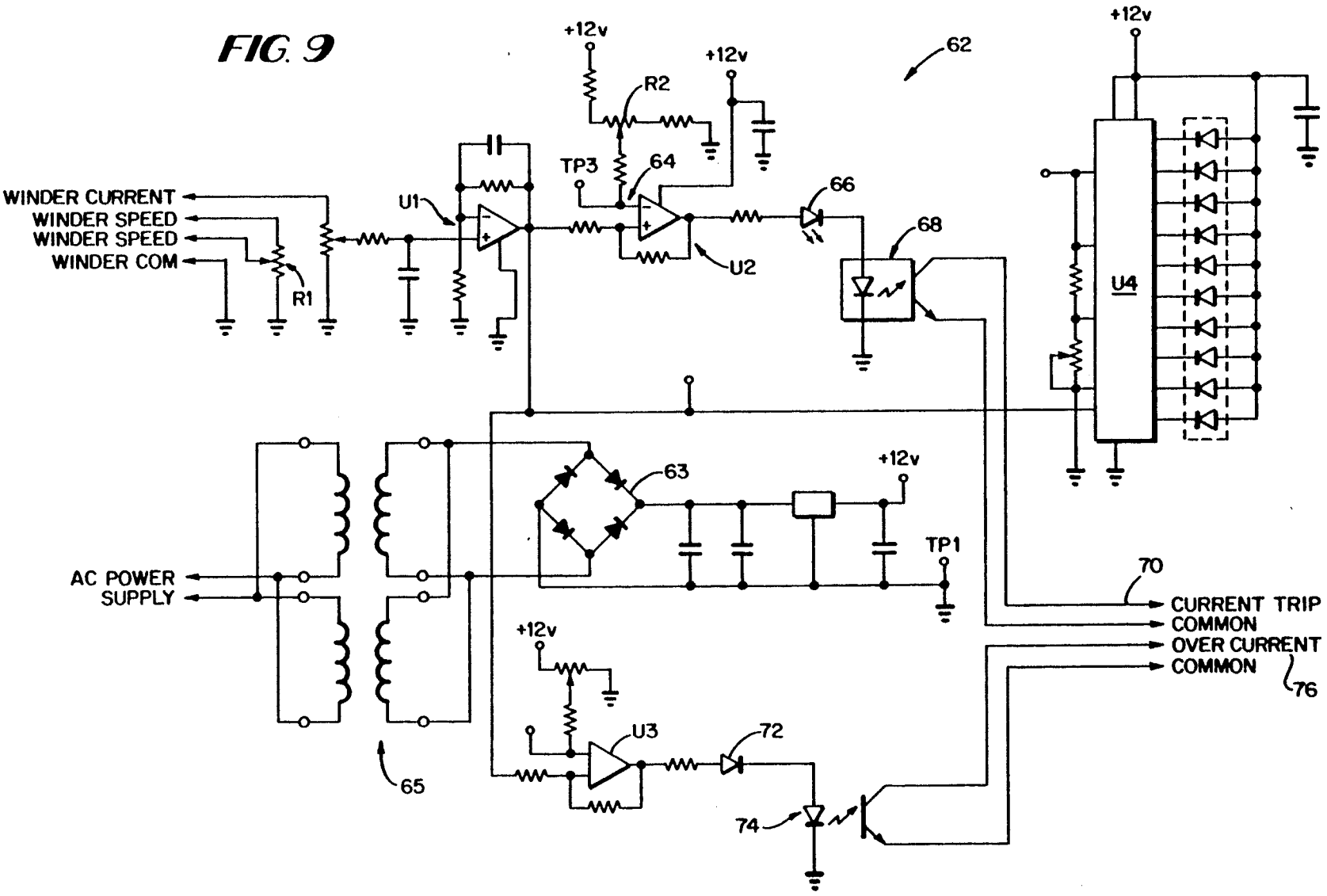
FIG. 9 is an electronic schematic diagram of the current trip circuit board shown in FIG. 8.

FIG. 9 is a schematic diagram of the current trip circuit board 62. The individual components are evident from the schematic diagram and only the major circuit elements need be discussed for a full understanding of the operation of this circuit. The rewinder motor speed is controlled by variable resistor R1. An integrated signal indicative of the current from the rewinder motor is generated by integrator U1 and provided to a comparator circuit U2. This current signal is compared to a DC voltage signal (TP) derived from a bridge rectifier circuit 63 and adjusted by the center tap of variable resistor R2. The bridge rectifier circuit converts to DC voltage the AC voltage obtained from the power supply through transformer 65.

If the rewinder current signal exceeds the adjusted standard signal (TP), the comparator U2 generates a signal that illuminates photodiode 66 and triggers photo-transistor 68. When turned on, the photo-transistor sends a current trip signal 70 to the microcontroller indicating that the current in the rewinder motor has reached the threshold current level for triggering an incremental upward movement of the rewinder.

The integrated rewinder current signal is also provided to an over current comparator circuit U3. The over current comparator circuit compares the rewinder current signal to a voltage standard, but one which is higher than the standard applied by comparator U2. If the rewinder current signal is greater than the higher standard applied in comparator U3, then the comparator issues a signal that illuminates light emitting diode 72 and triggers the gate of photo-transistor 74. When triggered, the photo-transistor sends an over current signal 76 to the microcontroller 60.

The integrated rewinder current signal is additionally displayed by bar graph meter U4. This meter is conventional and includes a bank display of photodiodes. As the current signal increases the number of photodiodes illuminated also increases. This bar graph allows the operator to monitor the current load on the rewinder motor.

Figure 10:
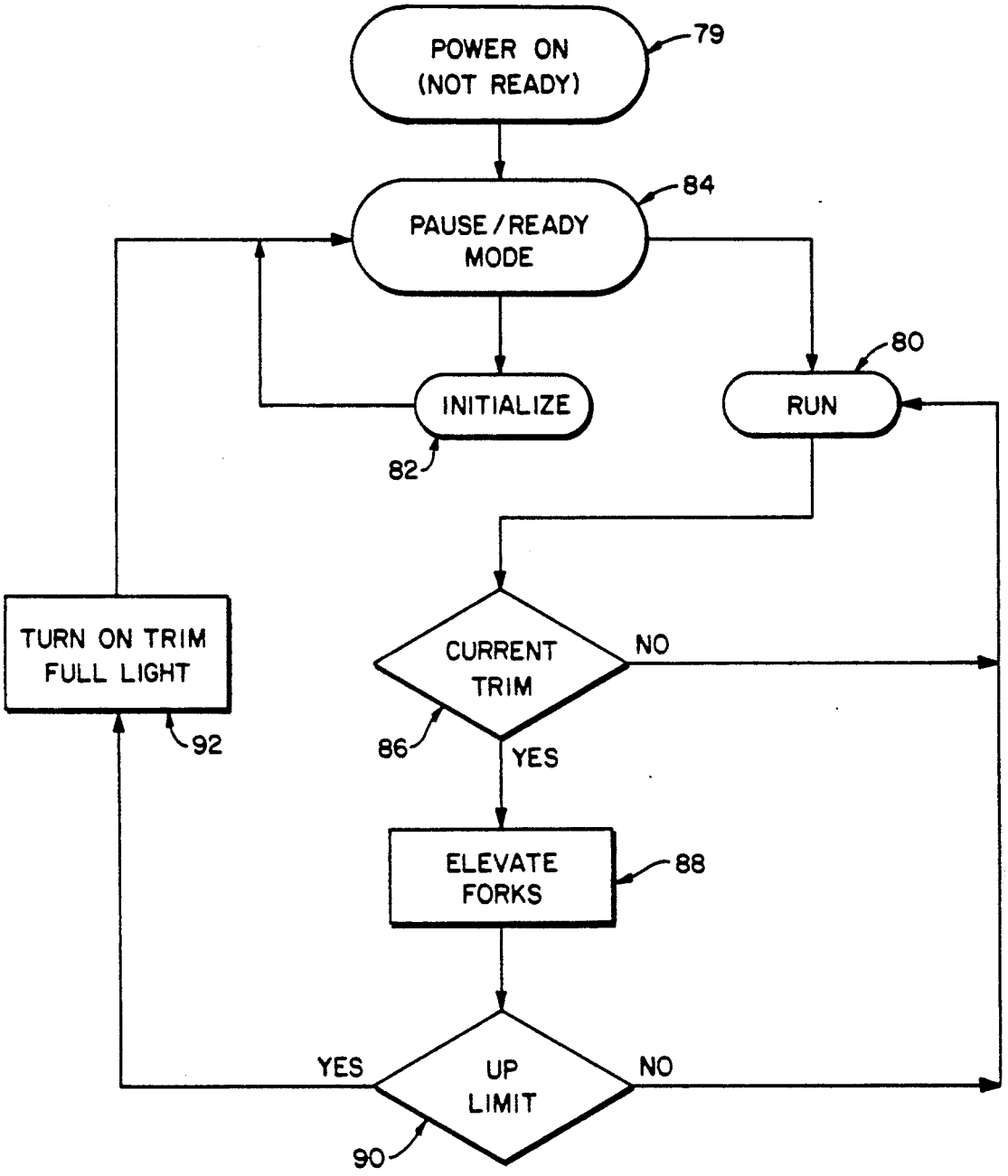
FIG. 10 is a computer software flowchart illustrating the operation of the circuits shown in FIGS. 8 and 9.

FIG. 10 is a computer program flow chart showing in general steps the operation of the microcontroller 60. At the start 79 of the program the system is at rest and the microcontroller confirms that power is available for the system motors and other electrical components. When a ready signal 84 is received from the manual switches 68 and when the trim door is closed, the microcontroller begins a initialization procedure 82.

During the initialization procedure 82, the microcontroller resets the operational components of the system, such as moving the rewinder to the bottom of the drum, and confirms that the drum door 21 is closed. If a detacher is operatively coupled to the system and the detacher is turned on during the initialization procedure, the system is put in run mode 80 and operates normally until signalled to stop.

The initialization procedure starts the rewinder spinning and, after a short time-out delay, the microcontroller checks the current trip circuit to confirm for a current trip signal. The time-out delay allows for current surges through the rewinder motor to expire to prevent the microcontroller from reading false current trip signals. In normal operation, no current trip signal will exist during the initialization procedure. If a current trip signal does exist, it suggests that a paper bale may still be in the drum.

Once the initialization procedure is completed, the microcontroller enters a ready pause state 84 and waits for a run signal 80 to activate the system. When this signal is received, the vacuum motor and winder motor turn on and paper trim is drawn into the funnel 10 through the hose 16 and enters the drum 18 and wound into a bale by the rewinder. As the rewinder bales the trim, the current load on the rewinder motor increases. The run state continues while the microcontroller waits for a current trip signal from the current trip circuit 62. Upon reading a current trip signal 86, the microcontroller first confirms that the time-out timers have expired to avoid reacting to a false trip signal. If these timers have expired, then the microcontroller reacts to a current trip signal by causing the elevator motor 38 to incrementally elevate 88 the tines and rewinder in the drum.

When the upper limit of travel of the rewinder is reached 90, the microcontroller causes the trim full light 41 to illuminate 92 and stops the system until the paper bale has been removed from the bin. Similarly, when an over-current condition exists in the rewinder motor, the current trip circuit provides an over-current signal to the microcontroller that causes the system to stop and the trim full light to turn on. Delay timers during start up prevent the microcontroller from reacting to false over-current signals. Once the paper bale is removed from the bin and the drum door closed, the system is ready to be restarted.

The invention has been described in what is currently considered to be its preferred embodiment. This invention is not limited to the disclosed embodiment. Rather, the invention covers the various modifications and equivalent arrangements included within the spirit and scope of the appended claims.

What is claimed is:

1. A web trim rewinder comprising:

a drum having a port for receiving web trim;

a trim rewinder including at least one elongated member rotatably mounted within said drum, said elongated member moving towards the center of said drum;

rotating motor means for rotating said elongated member, so as to catch and bale said web trim in said drum, and an elevator motor means for moving said elongated member towards said center of the drum and simultaneously rotating to catch and bale said web trim.

2. A web trim rewinder as claim 1 wherein said web trim is paper tractor drive strips.

3. A web trim rewinder comprising:

a drum having a port for receiving web trim;

a trim rewinder including an elongated member that comprises a rotatable rigid disk from which extends two or more times, said elongated member moving towards the center of said drum;

rotating motor means for rotating said elongated member so as to catch and bale said web trim in said drum, and an elevator motor means for moving said elongated member towards said center of the drum.

4. A web trim rewinder comprising:

a cylindrical drum having a port for receiving web trim;

a trim rewinder including an elongated member rotatably mounted within said drum, said elongated member moves radially and incrementally towards the center of the drum;

rotating motor means for rotating said elongated member to catch and bale said web trim in said drum, and an elevator motor means for moving said elongated member towards said center of the drum.

5. A web trim and dust collector system comprising:

a funnel receiving web trim and dust;

a drum having a port coupled to a first vacuum hose also coupled to said funnel, said web trim and dust being conveyed from said funnel to said drum through said first vacuum hose and said port;

a trim rewinder mounted in said drum;

a dust trap mounted to said drum at a portion of said drum having dust holes for communicating air and dust from said drum into said dust trap, said dust trap comprising a bin collecting dust, a dust filter, and a vacuum pump receiving air passed through said filter, said vacuum pump creating a suction vacuum in said drum, vacuum hose and funnel.

6. A web trim and dust collector as in claim 5 wherein said rewinder moves towards the center of said drum as said rewinder bales the web trim in said drum.

7. A method for collecting web trim in a cylindrical drum comprising an inlet for trim and a rotatable rewinder having at least one elongated member, said method comprising the steps of:

a. positioning the rewinder within the drum near a wall of the drum, b. injecting web trim into the drum through the inlet, c. rotating the rewinder so that the elongated member catches and bales the web trim, d. dragging the bale of web trim between the rotating member and drum wall to compact the bale around the elongated member, e. moving the rotating rewinder towards the center of the drum as the drag of the bale on the rewinder increases, and f. stopping the rewinder and removing the bale from the drum.

8. A method for collecting web trim as in claim 7 wherein step (e) further comprises moving the rewinder to the center of the drum so that the bale substantially fills the drum.

9. A method of collecting web trim as in claim 7 wherein step (e) is performed by incrementally moving the rewinder towards the center of the drum in discrete steps, and each incremental movement being performed after the drag on the rewinder reaches a predetermined threshold level.

10. A method of collecting web trim in a cylindrical drum comprising an inlet for trim and a rotatable rewinder having at least one elongated member and a dust trap including a bin, filter and vacuum, pump, said method comprising the steps of:

a. positioning the rewinder within the drum near a wall of the drum, b. injecting web trim into the drum through the inlet, c. rotating the rewinder so that the elongated member catches and bales the web trim, d. dragging the bale of web trim between the rotating member and drum wall to compact the bale around the elongated member, e. moving the rewinder towards the center of the drum as the drag of the bale on the rewinder increases, f. drawing by suction dust in the drum through holes in the wall of the drum and into the dust trap, and g. separating the air and dust entering the dust trap so that the dust falls into a bin and the air is drawn through the filter into the vacuum pump.

11. A method for collecting web trim in a cylindrical drum comprising an inlet for trim, a rotatable rewinder having at least one elongated member and an electrical motor, and a control circuit said method comprising the steps of:

a. positioning the rewinder within the drum near a wall of the drum, b. injecting web trim into the drum through the inlet, c. rotating the rewinder so that the elongated member catches and bales the web trim, d. dragging the bale of web trim between the rotating member and drum wall to compact the bale around the elongated member, e. monitoring the current load on the rewinder motor with a control circuit;

f. when the current load exceeds a preselected threshold level, moving the rewinder towards the center of the drum as the drag of the bale on the rewinder increases, and g. stopping the rewinder and removing the bale from the drum.

12. A method as in claim 11 wherein step (f) is accomplished by incrementally moving the rewinder when the current loads exceeds the threshold level.

13. A method as in claim 11 wherein step (f) further comprises determining whether the rewinder has moved to the center of the drum before proceeding to step (g).

* * * * *